US010605274B2

(12) United States Patent
Neef

(10) Patent No.: US 10,605,274 B2
(45) Date of Patent: Mar. 31, 2020

(54) VALVE ARRANGEMENT

(71) Applicant: Festo AG & Co. KG, Esslingen (DE)

(72) Inventor: Bodo Neef, Neuhausen (DE)

(73) Assignee: FESTO AG & Co. KG, Esslingen (DE)

( * ) Notice: Subject to any disclaimer, the term of this patent is extended or adjusted under 35 U.S.C. 154(b) by 204 days.

(21) Appl. No.: 15/526,894

(22) PCT Filed: Jun. 9, 2015

(86) PCT No.: PCT/EP2015/062804
§ 371 (c)(1),
(2) Date: May 15, 2017

(87) PCT Pub. No.: WO2016/198094
PCT Pub. Date: Dec. 15, 2016

(65) Prior Publication Data

US 2017/0328383 A1 Nov. 16, 2017

(51) Int. Cl.
*F15B 13/043* (2006.01)
*F15B 13/04* (2006.01)
(Continued)

(52) U.S. Cl.
CPC ..... *F15B 13/0405* (2013.01); *F15B 13/0431* (2013.01); *F15B 13/0889* (2013.01);
(Continued)

(58) Field of Classification Search
CPC ..... F15B 2013/006; F15B 2211/8855; F15B 2211/8752; F15B 2211/87; F15B 2211/8623; F15B 2211/857; F15B 2211/6306; F15B 2211/30565; F15B 13/0875; F15B 13/0587; F15B 13/0889;
(Continued)

(56) References Cited

U.S. PATENT DOCUMENTS 3,391,703 A * 7/1968 Kay ..... F15B 13/081 137/269
3,513,876 A * 5/1970 Tarbox ..... F15B 13/0817 137/269
(Continued)

FOREIGN PATENT DOCUMENTS

CN 201696386 U 1/2011
CN 102575692 A 7/2012
(Continued)

*Primary Examiner* — Craig J Price
(74) *Attorney, Agent, or Firm* — Hoffmann & Baron, LLP

(57) ABSTRACT

A valve arrangement for a fluidic supply of a fluid load, with several main valves designed for influencing fluid flows at the fluid ports, and with electrically controllable pilot valves designed for fluidic control of the main valves. A base body is assigned a connection plate lying opposite a connection face and having a fluid passage which leads into an operating port for the connection of a fluid load wherein, between the connection face and the connection plate there is provided a separate passage body which has at least one connection passage for a fluidically communicating link between at least one of the fluid ports and the operating port, and at least one connecting conduit for a fluidic coupling of at least two fluid ports.

9 Claims, 4 Drawing Sheets

(51) Int. Cl.
*F15B 13/08* (2006.01)
*F15B 21/044* (2019.01)
*F15B 13/00* (2006.01)

(52) U.S. Cl.
CPC ..... *F15B 21/044* (2013.01); *F15B 13/043* (2013.01); *F15B 13/0433* (2013.01); *F15B 13/0857* (2013.01); *F15B 13/0875* (2013.01); *F15B 2013/006* (2013.01); *F15B 2211/30565* (2013.01); *F15B 2211/6306* (2013.01); *F15B 2211/857* (2013.01); *F15B 2211/8623* (2013.01); *F15B 2211/87* (2013.01); *F15B 2211/8752* (2013.01); *F15B 2211/8855* (2013.01); *Y10T 137/87885* (2015.04)

(58) Field of Classification Search
CPC ..... F15B 13/0431; F15B 13/0405; F15B 21/044; F15B 13/043; F15B 13/87885; Y10T 137/5283; Y10T 137/87885
USPC ..... 137/625.6, 625.64, 625.65, 625.66, 137/596.16, 596.17, 596.18, 884, 487.5, 137/833, 557
See application file for complete search history.

(56) References Cited

U.S. PATENT DOCUMENTS 3,556,144 A 1/1971 Bickers et al.
3,688,797 A * 9/1972 Sorenson ..... F15B 13/0402 137/625.64
3,779,136 A * 12/1973 Hohlein ..... F15B 11/08 91/361
4,796,661 A * 1/1989 Hishinuma ..... G05D 16/2093 137/487.5
5,222,524 A * 6/1993 Sekler ..... F15B 13/0817 137/269
5,341,841 A * 8/1994 Schaefer ..... F15B 13/081 137/561 A
5,975,134 A * 11/1999 Schwelm ..... F15B 11/006 137/596.15
6,189,571 B1 * 2/2001 Hedlund ..... F15B 13/081 137/269
6,505,642 B2 * 1/2003 Miyazoe ..... F15B 13/0817 137/554
6,612,332 B2 * 9/2003 Miyazoe ..... F15B 13/0431 137/552
7,171,985 B2 * 2/2007 Eltrop ..... F15B 13/0817 137/269
7,874,456 B2 * 1/2011 Bolyard, Jr. ..... B05C 11/1042 137/884
2008/0042084 A1 * 2/2008 Fuller ..... F16K 99/0001 251/26
2012/0279592 A1 * 11/2012 Manofsky, Jr. ..... G05D 7/00 137/597
2017/0342686 A1 * 11/2017 Jeon ..... E02F 9/22

FOREIGN PATENT DOCUMENTS

DE 19537482 4/1997
DE 69915012 11/2004
DE 102009023706 12/2010

* cited by examiner

VALVE ARRANGEMENT

This application claims priority based on an International Application filed under the Patent Cooperation Treaty, PCT/EP2015/062804, filed Jun. 9, 2015.

BACKGROUND OF THE INVENTION

The invention relates to a valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves which are designed for fluidic control of the main valves.

DE 10 2009 023 706 A2 discloses a pneumatic position controller with an operating element and a valve unit acting on the former, comprising two piezo-pneumatic valves coupled together, with a signal input for an electrical control signal, and also a supply inlet which may be connected to a pressurised gas supply and an operating outlet connected to the pneumatic operating element plus a venting outlet for the operating medium. At the same time each of the valves has a valve casing with a hollow mounting space and a function-specific valve insert which may be inserted therein with sealing and which has a switch unit subject to a through flow. The valve insert and the valve body acting in conjunction with it are provided on the switch unit. Flow passages arranged in the valve casing lead into the assigned hollow mounting space in such a way that, with an identical valve casing, different functional characteristics of the valve concerned may be obtained by replacing the valve insert.

SUMMARY OF THE INVENTION

The problem of the invention lies in the provision of a valve device in which adaptation to different cases of application can be made easily.

This problem is solved for a valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves which are designed for fluidic control of the main valves, wherein the base body is assigned a connection plate lying opposite the connection face and through which runs a fluid passage which leads into an operating port for the connection of a fluid load wherein, between the connection face and the connection plate there is provided a separate passage body which has at least one connection passage for a fluidically communicating link between at least one of the fluid ports and the operating port, and at least one connecting conduit for a fluidic coupling of at least two fluid ports.

At the same time the connection plate serves preferably as a customer-side interface for the connection of the fluid load at the operating port and where applicable for the connection of further fluidic components such as for example a fluid source and/or an exhaust air silencer. The connection plate may be provided either as integral with the base body or as a separate component for fitting to the base body, in particular by means of screw connections. The critical factor is the provision, between the connection face of the base body and a surface of the connection plate facing the connection face of the base body, of a volume of space in which the separately formed passage body may be inserted. The task of the passage body is to provide a presettable fluidic interconnection between the fluid ports which are formed on the connection face of the base body. By exchanging the passage body for a passage body of different design, it is possible to preset different fluidic interconnections between the main valves, thereby obtaining properties for the valve arrangement at the operating port. Here the fluidic interconnections in the passage body comprise on the one hand the connection passage, which is designed for a direct or indirect fluidic connection between each fluid port on the base body and the fluid passage formed in the connection plate and having fluidic connection with the operating port, together with the connecting conduit which is provided for a fluidic connection of at least two fluid ports and by this means makes possible fluidic coupling of at least two main valves. At the same time it may be provided that one connecting conduit connects solely two or more fluid ports to one another. Alternatively it may be provided that one connecting conduit, besides connecting two fluid ports, also makes fluidic connection with the connection passage and/or with a supply port or an air outlet port.

Advantageous developments of the invention are the subject of dependent claims.

It is expedient for at least one main valve and/or at least one pilot valve to have a preset valve position. The preset valve position is preferably a fully open position or a fully closed position for the valve concerned. The preset valve position is ensured in particular by pre-tensioning means, such as for example a compression spring, wherein the compression spring acts so in particular on a valve member of the relevant valve. A movement of the valve member out of the presettable valve position requires that the pre-tensioning means be overcome; for this purpose the relevant valve may be assigned for example an electro-mechanical drive, in particular a solenoid actuator, or a fluidic drive in the form of a pneumatic cylinder. Accordingly, provision of electrical or fluidic power is necessary to bring the relevant valve from the preset valve position into a second valve position or functional position, wherein in this connection energy storage takes place in the pre-tensioning means. In the event of failure of the electrical or fluidic power required to control the valve concerned, the valve or the valve body of the valve returns to the preset valve position on account of the energy stored in the pre-tensioning means. By way of example it is provided that the pilot valves are designed as electro-mechanically driven valves, while the main valves are designed as fluidically controlled valves.

In a further variant of the invention it is provided that, in the connection plate, a further fluid passage is formed which opens out into a supply port or an air outlet port, and that in the passage body there is formed a further connection passage and/or a further connecting conduit for a fluidically communicating connection between at least one of the fluid ports and the supply port or the air outlet port and/or for a fluidic coupling of at least two further fluid ports.

This makes possible complex fluidic interconnections between the fluid ports and where applicable between the supply port and/or the air outlet port, with which it is possible to define presettable function modes for the so main control valves, in particular in the event of failure of an electrical supply for the pilot valves and/or a fluidic supply for the pilot valves and/or the main control valves. Since the passage body is separate from the base body, it may be exchanged, preferably without tools, so that adaptation of the valve arrangement to different case of application is simplified. Since the functioning of the valve arrangement is determined critically, in particular solely, by the fluidic interconnection of the fluid ports, the valve arrangement is suitable in particular for safety-oriented supply of a fluid load, which may involve in particular a pneumatic cylinder or a pneumatic swivel drive.

Accordingly it is advantageous if there are formed in the passage body several connecting conduits, which are designed for presettable fluidic interconnection of the main valves with the operating port and the supply port and the air outlet port.

Preferably it is provided that the main valves, preferably four, are similarly designed, in particular identically designed. This ensures advantageous variability of the valve arrangement in respect of different options for fluidic interconnection of the individual, in particular four, main valves. Preferably it is provided that each of the main valves is of similar design and in particular has valve bodies fluidically controlled by membrane chambers. Advantageously it is provided that the membrane chambers of a main valve are in each case pressure-compensated, so that a pressure level of fluid for control by the main valve is irrelevant for the function of the main valve, at least so within a certain presettable pressure interval. By way of example, the main valves are normally closed (NC) or normally open (NO) valves. It is especially preferred if all main valves of the valve arrangement are of identical design.

In an advantageous development of the invention it is provided that information interfaces corresponding to one another are located on the base body and on the passage body, and are designed for data interchange between an electronic memory device in the passage body and an electronic processing device in the base body. With the aid of the information interfaces, electrical or electronic transmission of information between the memory device in the passage body and the electronic processing device in the base body is possible. For example, information on the fluidic interconnection in the passage body may be stored in the memory device. In addition or alternatively it may be provided that the memory device is designed for buffer storage of sensor values provided by sensor means located in the passage body. In addition or alternatively it may be provided that the memory device is designed for storage of parameters which are provided by the processing device and may be consulted for parameterisation of the sensor means located in the passage body. Accordingly, either a unidirectional or a bidirectional data interchange between the memory device and the processing device is provided. At the same time, the information interface may be designed for direct electrical coupling between passage body and base body; alternatively the information interface is designed for wireless data transmission between passage body and base body, in particular optical or inductive.

It is expedient if the base body includes the connection plate, and if a locating shaft for the passage body is formed between the connection face and the connection plate, wherein the passage body may be attached in at least one functional position for the fluidically communicating interconnection of the main valves with the operating port and the supply port and the air outlet port in the locating shaft. In this variant of the base body it is preferably provided that the passage body is inserted into the locating shaft parallel to the connection face of the base body and fixed in a preset functional position between the connection face and the connection plate. By this means it is possible to realise especially simple fitting of the passage body to the base body. It is especially preferred for the passage body and the locating shaft to be so matched to one another that an exactly presettable functional position of the passage body relative to the base body must be maintained for a function of the valve arrangement, in order to prevent malfunctions of the valve arrangement if the passage body is fitted incorrectly.

In a further variant of the invention it is provided that the separately formed connection plate is designed for attachment of the connection face and includes a locating shaft for the passage body, wherein the passage body may be attached in at least one functional position for the fluidically communicating interconnection of the main valves with the operating port and the supply port and the air outlet port in the locating shaft. In this alternative variant of the valve arrangement, the passage body is at least almost completely accommodated in a recess in the connection plate and is fixed to the base body together with the connection plate. In this way it is possible to obtain an especially simple configuration of the passage body and the connection face, in particular in respect of the fluidic sealing between passage body and connection face and also the connection plate. Preferably the connection plate has an air outlet port in communicating connection with the recess for accommodating the passage body which, with the passage body inserted, is sealed and which in the absence of the passage body ensures that no provision of pressurised fluid takes place at the operating port, so that by this means malfunctions of the valve arrangement may be avoided.

It is advantageous if the connection passage and/or the connecting conduit is or are assigned at least one pneumatic component from the group: pressure-control valve, restrictor valve, control valve. With such a pneumatic component, the control system response of the valve arrangement may be influenced actively or passively. An active influencing of the control system response may be achieved, in particular with the aid of at least one electrically or fluidically, preferably pneumatically driven control valve which is assigned to the connection passage or the connecting conduit and can influence a free fluidic cross-section of the respective passage, in particular between an open position and a closed position. A passive influence on the control system response of the valve arrangement may be obtained for example by an electrically or manually adjustable pressure-control valve or restrictor valve, through regulation of fluid flows between the fluid ports to a presettable pressure level, or restriction to a presettable volumetric flow.

Preferably it is provided that the connection passage and/or the connecting conduit are or is assigned at least one sensor means from the group: pressure sensor, flow sensor, temperature sensor. With the aid of such sensor means, which give out in analog or digital form a sensor signal based on a measured physical variable, statements are possible as to the manner in which the valve arrangement and/or fluid loads connected to the valve arrangement are currently behaving or will behave in the near future. From this information, possible changes in the provision of pressurised fluid to the fluid loads, in particular through suitable control of one or more of the main valves, may be effected.

In an advantageous embodiment of the invention it is provided that the operating port on the connection plate is assigned a valve plate including at least one control valve, which is designed to influence a fluid flow between a fluid source and a fluid load, wherein a fluidic control connection of the control valve is in fluidically communicating connection with the operating port and wherein the valve plate is assigned at least one sensor means from the group: pressure sensor, flow sensor, temperature sensor, position sensor, wherein the sensor means are electrically connected to the connection plate or are accommodated in the connection plate. With such a valve plate it is possible for example to increase the limited flow capacity of the valve arrangement so that fluid loads with a high fluid consumption may also be controlled. Located in the valve plate is one control valve which is designed for example for the correspondingly high flow and which, with the aid of the valve arrangement, is fluidically piloted, in particular via its operating port. For monitoring the position of so this control valve, the valve plate is assigned at least one sensor means, with the aid of which a functional position of the control valve may be directly or indirectly established so that from this, conclusions may be drawn as to the function of the controlled fluid load and/or the function of the control valve. Preferably the sensor means are included in a control circuit which is designed for control of the valve arrangement. By this means, a short reaction time for control of the valve arrangement and the control valve connected to it may be realised. The sensor means may be located in the valve plate, in which case a sensor signal of the sensor means is provided to the connection plate over a suitable sensor interface, and from there may be passed on for example to a processing device in the base body. Alternatively, the sensor means are located in the connection plate, and the valve plate contains only a sensor passage for fluidic coupling of the operating passage to the sensor means.

In an alternative variant of the invention it is provided that the operating port is assigned on the connection plate a valve plate which includes at least one control valve, which is designed to influence a fluid flow between the operating port and a fluid load, wherein an electrical control connection of the control valve is connected to a control interface and wherein the control valve has a preferred position, preferably normally closed. The task of this control valve is to ensure a reliable switch-off of the fluidic supply of the fluid load, which is of interest in particular in respect of safety-oriented cases of application for the valve arrangement. The control valve is an electrically controlled valve, in particular a solenoid valve, which so without provision of electrical power is to be found in a preferred position, in particular in a closed position. The electrical supply of this control valve is effected preferably directly by a safety-oriented controller which if applicable is also designed for control of the valve arrangement and/or to determine a functional position of the controlled fluid load. Alternatively it may be provided that the control valve, without provision of electrical power, is to be found in an open position, therefore ensuring venting of the fluid load in the event of failure of the control for the valve arrangement and/or the control valve. By this means, on account of the dual-channel redundant venting of the fluid load, a high level of safety for the valve arrangement is ensured.

BRIEF DESCRIPTION OF THE DRAWINGS

Advantageous embodiments of the invention are shown in the drawing, including in.

DETAILED DESCRIPTION OF THE PREFERRED EMBODIMENTS

Figures 1, 2, 2A:
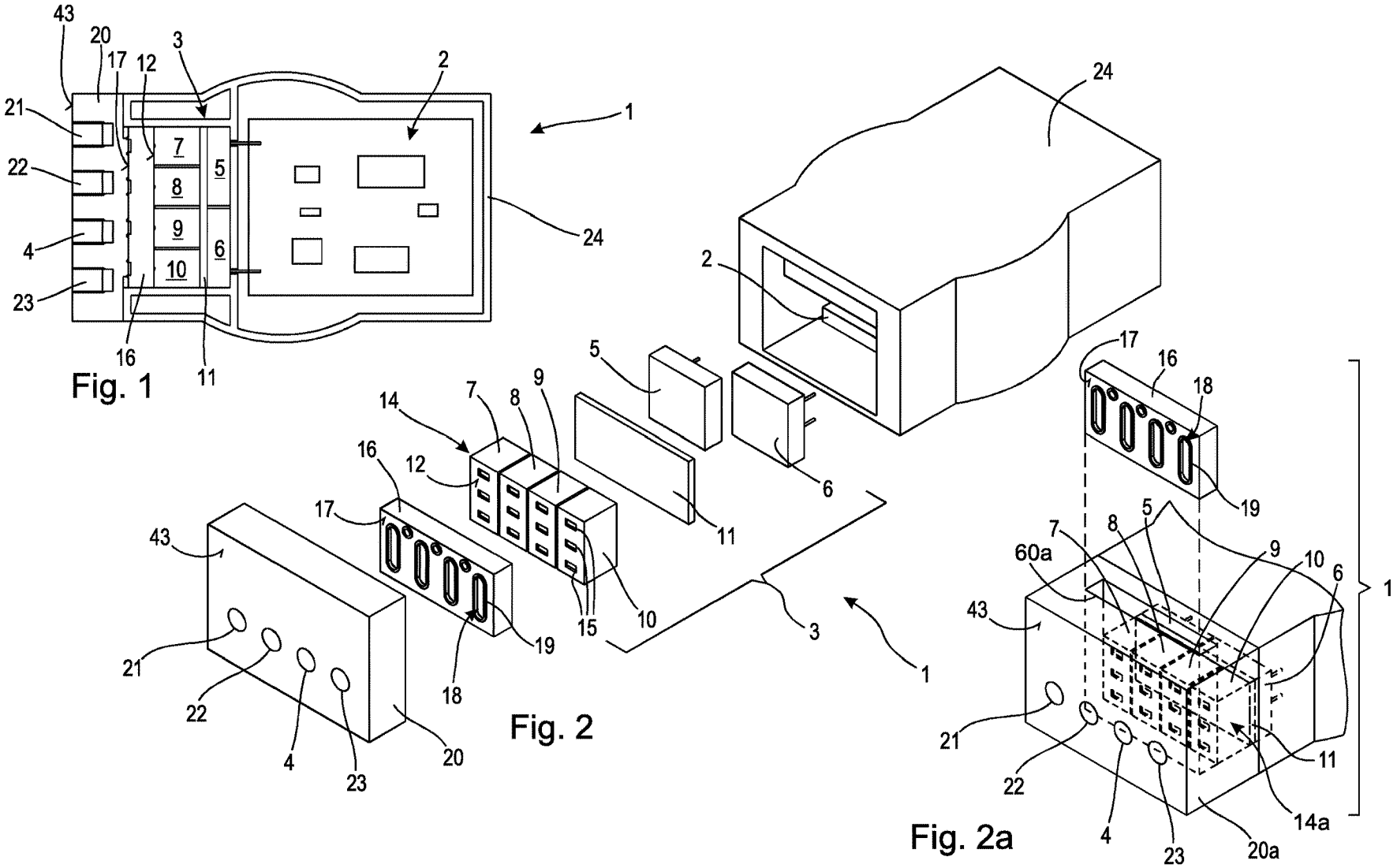
FIG. 1 a schematic plan view of a control unit including a valve arrangement with two pilot valves, four main valves, a passage body and a connection plate, which are mounted in a control housing, wherein the connection plate is assigned a valve plate FIG. 2 an exploded view of the control unit according to FIG. 1
FIG. 2*a* an alternative embodiment of the control unit including a connection plate with a locating shaft FIG. 3 a first embodiment of a valve plate FIG. 4 a second embodiment of a valve plate FIG. 5 a schematic connection diagram of a first embodiment of a valve arrangement FIG. 6 a schematic connection diagram of a second embodiment of a valve arrangement, and FIG. 7 a schematic connection diagram for the first embodiment of the valve plate.

A control unit 1 shown in FIGS. 1 and 2 is provided for fluidic supply of a fluid load, not shown, which may involve for example a pneumatic cylinder or a pneumatic swivel drive. The control unit 1 may be designed for autonomous operation without external control signals and/or for linking to a higher-level control unit, not shown, designed for the provision of control signals, which may involve in particular a programmable control system (PLC). The control unit 1 includes control electronics 2, which may be for example in the form of a printed circuit board or printed circuit equipped with electronic and electrical components such as for example a microprocessor. The control electronics 2 are designed for the processing of control commands provided either by a control program running on the control electronics 2 or by a higher-level control unit, and which are converted by a valve arrangement 3 into fluid flows at an operating port 4.

For reasons of simplification, the fluid passages required between the fluidic components described in detail below are not shown in FIGS. 1 to 3. A detailed representation of the fluidic interconnection of these fluidic components is provided in the typical embodiments of FIGS. 4 and 5.

The control electronics 2 are connected electrically to the two pilot valves 5, 6, which are by way of example solenoid valves, preferably 2/2-way valves, in particular 3/2-way valves, as shown. The pilot valves 5, 6 are supplied by the control electronics 2 with electrical power, in order to provide fluid flows at the main valves 7 to 10. Preferably the control electronics 2 and the pilot valves 5, 6 are designed for control via an analog current interface, preferably with a maximum amperage of 20 mA, in particular with a fraction thereof, and therefore meet the requirements frequently specified in process technology for "low power" terminal devices. The main valves 7 to 10 are fluidically controllable valves, for example fluidically piloted 3/2-way valves. Preferably it is provided that the main valves 7 to 10 are in the form of membrane-controlled pressure-compensated valves, making possible advantageous switching behaviour for the main valves 7 to 10. Fitted between the pilot valves 5, 6 and the main valves 7 to 10 is an adapter plate 11, through which pass recesses, not shown, in order to ensure a fluidically communicating connection between the exit ports, not shown, of the pilot valves 5, 6, and the inlet ports, not visible in FIGS. 1 and 2, of the main valves 7 to 10. By way of example, the adapter plate 11 may also be designed to provide a sealing effect between the pilot valves 5, 6 and the main valves 7 to 10.

By way of example it is provided that both the pilot valves 5, 6 and also the main valves 7 to 10 are cuboidal in shape and in flat sealing contact with one another, thus also forming the base body 14 in this embodiment of the valve arrangement.

At a surface 12 opposite the pilot valves 5, 6, the main valves 7 to 10 each have several valve ports 15, which are designed for the provision of fluid flows, described in detail below, through the respective main valves 7 to 10, and which therefore form the fluid ports of the base body 14.

Lying opposite the surface 12 of the main valves 7 to 10 is a passage body 16, which is preferably cuboidal in shape and provided for sealing contact at the surface 12. The passage body 16 has at least one connection passage and connecting conduit, not discernible in FIGS. 1 and 2, but shown in detail in FIGS. 4 and 5. The passage body 16 is provided at a surface facing one of the main valves 7 to 10 and also at a surface 17 facing away from the main valves 7 to 10 with outlet openings 18, each bordered by an annular seal 19, wherein the connection passage leads into at least one of the outlet openings 18. The passage body 16 is by way of example provided for location in a connection plate 20, which in turn is by way of example basically cuboidal and has a recess, not visible in FIG. 2, which is so matched to the geometry of the passage body 16 that the passage body 16 may be located in the connection plate 20 at least almost completely flush-fitting.

Provided on the connection plate 20 are by way of example, besides the operating port 4, a supply port 21, an air outlet port 22 and a reserve port 23, wherein the reserve port 23, depending on the interconnections in the passage body 16, may also be in the form of a second operating port. At the same time, the supply port 21 is provided for fluidic coupling with a fluid source, not so shown, and thus for the fluidic supply of the control unit 1. The air outlet port 22 may be connected in particular to a silencer, not depicted, in order to convey exhaust air away from the control unit 1 as quietly as possible.

The connection plate 20 is provided for flat contact with a housing 24 of the control unit 1, and may be fixed to the housing 24 by mounting means, not shown, in particular screws. In the fixing of the connection plate 20 to the housing 24, the seals 19 on the passage body 16, together with further sealing means, not shown, between the pilot valves 5, 6 and the main valves 7 to 10, the adapter plate 11 and the passage body 16, are compressed, thereby ensuring fluidic sealing amongst one another so that, on application of a supply pressure at the supply port 21, no significant losses of fluid occur in the control unit 1. Preferably it is provided that fluid passages 44 pass through the connection plate 20 and ensure in each case fluidic connections between the operating ports 4, supply ports 21, air outlet ports 22 and reserve ports 23 formed on both sides of the connection plate 20.

The alternative embodiment as shown in FIG. 2*a* is based on the embodiment according to FIG. 2, but in this alternative embodiment the base body 14*a* includes the connection plate 20*a*. Furthermore a locating shaft 60*a* for the passage body 16 is formed in the base body 14*a*, wherein the passage body 16 may be attached in the locating shaft 60*a*. It is preferably provided that the passage body 16 is inserted into the locating shaft 60*a* parallel to the connection face of the base body 14*a*.

Figure 4:
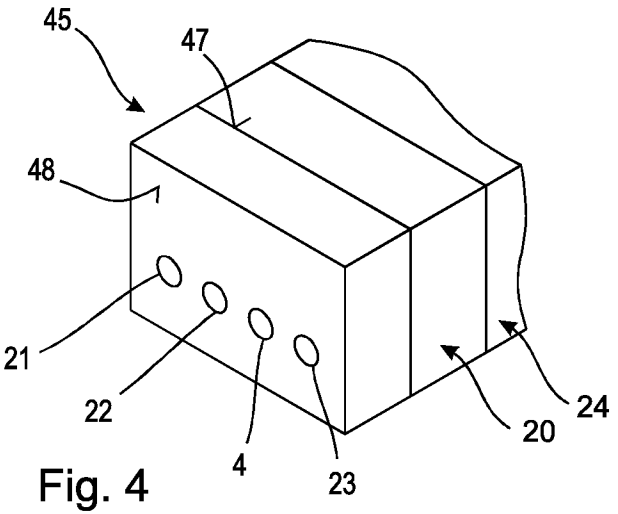
Figure 3:
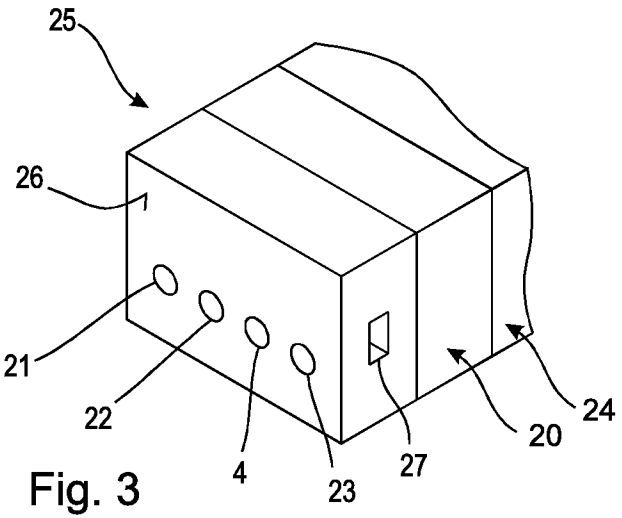
Figure 7:
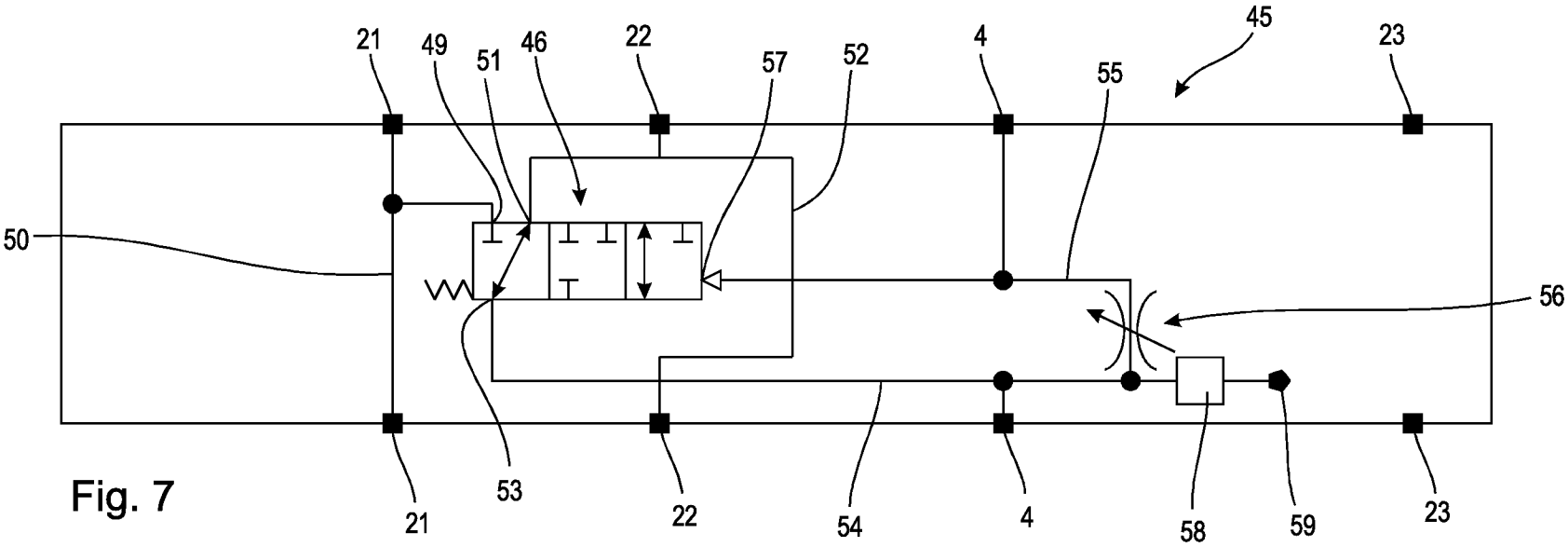

The alternative embodiments of valve plates 25, 45 shown in FIGS. 3 and 4 may be connected alternatively to the connection plate 20 and are provided with similar fluid ports as provided on the connection plate 20, i.e. an operating port 4, a supply port 21, an air outlet port 22 and a reserve port 23. For the valve plate 45, FIG. 7 shows a fluidic interconnection described in detail below. The valve plates 25 serve to extend the functional scope of the control unit 1, wherein the valve plate 25 is designed to reach a presettable safety level and in particular to realise preset safety functions such as fail-safe or fail-freeze for the control unit 1 equipped with it, while the valve plate 45 is designed for a high fluid flow rate.

Other valve plates, not depicted, may also be attached to the connection plate 20. By way of example t is provided that the relevant valve plate is screwed with sealing to the connection plate 20.

Figure 5:
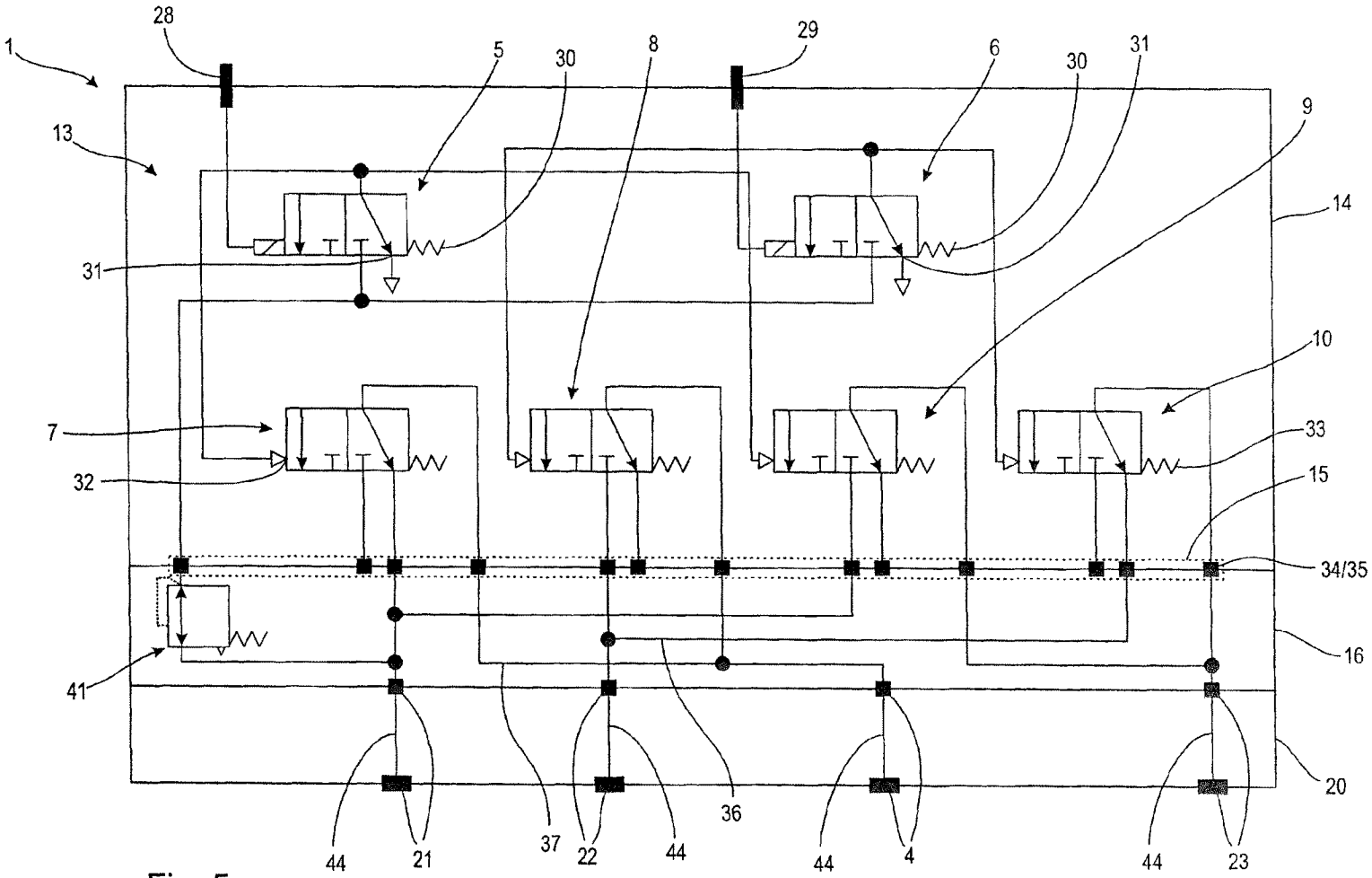

From the illustration of FIG. 5 one may gather how a typical fluidic interconnection of the pilot valves 5, 6 to the main valves 7 to 10 and the passage body 16 may be provided in the control unit 1. In the schematic view in FIGS. 5, 6 and 7, connections between fluid ports, in particular between connecting conduits, are symbolised by circular dots. Fluidic interfaces at outer surfaces are symbolised by squares. Operating ports are symbolised by lying rectangles and electrical interfaces by standing rectangles.

By way of example it is provided that the pilot valves 5, 6 are in the form of electrically controlled solenoid valves, each connected via an electrical interface 28, 29 to the control electronics, not shown in FIG. 5. Accordingly, by provision of a suitable control signal at the interface 28 or 29, a switching function of the respectively controlled pilot valve 5, 6 may be effected. By way of example, the pilot valves 5, 6 are each in the form of 3/2-way valves, wherein both pilot valves 5, 6 are biased mechanically in a preferred position, each by spring means 30 in particular in the form of a coil spring. In this preferred position of the pilot valves 5, 6, a fluidic connection between control ports 32 of the so main valves 7 to 10, by way of example fluidically controllable and a venting port 31 of the respective pilot valve 5, 6 is provided, so that the main valves 7 to 10, similarly each biased by spring means 33 in a preferred position, remain in this preferred position. It is also provided that the main valve 7 may be controlled by provision of a fluid flow from the pilot valve 5, while the main valve 8 may be controlled by provision of a fluid flow from the pilot valve 6.

The main valves 7 to 10 each have fluid ports 34 which are in sealing fluidically communicating connection with fluid ports 35 in the passage body 16. The task of the passage body 16 is to supply fluid flows provided to the main valves 7 to 10 and released by the main valves 7 to 10 in a suitable manner to the operating port 4 and the air outlet port 22 and, where applicable, to the reserve port 23. At the same time, the fluidic function of the control unit 1 is determined by the assignment of the connection passage 36 provided in the passage body 16 and the connecting conduits 37 provided in the passage body 16. As already described above, the passage body 16 may be interchanged, so that different fluidic functions may be preset for the control unit 1, as will be explained below in detail in conjunction with FIGS. 5 and 6.

By way of example, the passage body 16 is so designed and the preferred position of the main valve 7 so selected that, without fluidic control of the main valve 7, supply pressure applied to the supply port 21 is supplied with the aid of the main valve 7, via the connecting conduit 37, to the operating port 4. Moreover the preferred position of the main valve 8 is so selected that, without fluidic control of the main valve 8, fluidic connection between the operating port 4 and the air outlet port 22 is interrupted. Thus, without fluidic control of the main valves 7, 8, a fluid flow is facilitated from the supply port 21 via the main valve 7 and the connection passage 36 to the operating port 4.

As soon as the main valve 7 has been brought from the preferred position into a switch position, not shown, through provision of a fluid flow from the pilot valve 5, it is ensured by the fluidic interconnection of the connection passage 36 and the connecting conduits 37 in the passage body 16, that a fluidic connection between the supply port 21 and the operating port 4 is interrupted. In this case the fluid supplied to the fluid load, not shown, is as it were trapped, by which means the fluid load, for example in the form of a pneumatic cylinder, remains in a preset position and where applicable is able to provide a presettable force and the fluid load undergoes a change in state.

In a subsequent step it may be provided that main valve 8, by provision of a fluid flow from pilot valves 6, is brought from the preferred position into a switch position, not shown, in which a fluidically communicating connection is created between the operating port 4 and the air outlet port 22, so that the fluid supplied to the fluid load may flow away through the air outlet port 22.

By way of example there is provided in the passage body 16 a branch 39 from a supply passage 40, which connects the supply port 21 with the associated fluid port 34 of the main valve 7. The branch 39 is connected fluidically to a pressure-control valve 41 which is designed to reduce the fluid pressure applied to the supply port 21 and so to provide a reduced supply pressure at an assigned fluid port 34, 35. The supply pressure reduced by the pressure-control valve 41 is provided over a fluid line 42 to the two pilot valves 5, 6, and may be passed on by the two pilot valves 5, 6 as control pressure to the respective main valves 7 to 10.

By way of example the passage body 16 shown in FIG. 5 is provided for a fail-safe function in which, in the event of a failure of the electrical supply for the control electronics 2 and/or the pneumatic supply, defined status occurs for the fluid load, not shown, fluidically coupled to the control unit 1. In the event of failure of the electrical supply for the control electronics 2, the two pilot valves 5, 6 adopt the preferred position shown in FIG. 5, causing any control fluid pressurisation of the assigned main valves 7 to 10 to cease, with the main valves 7 to 10 similarly adopting their preferred position. In this case, the fluidic control represented in FIG. 5 of the fluid load, not shown, is available, with the latter being supplied with supply pressure provided at the supply port 21 via the main valve 7.

Figure 6:
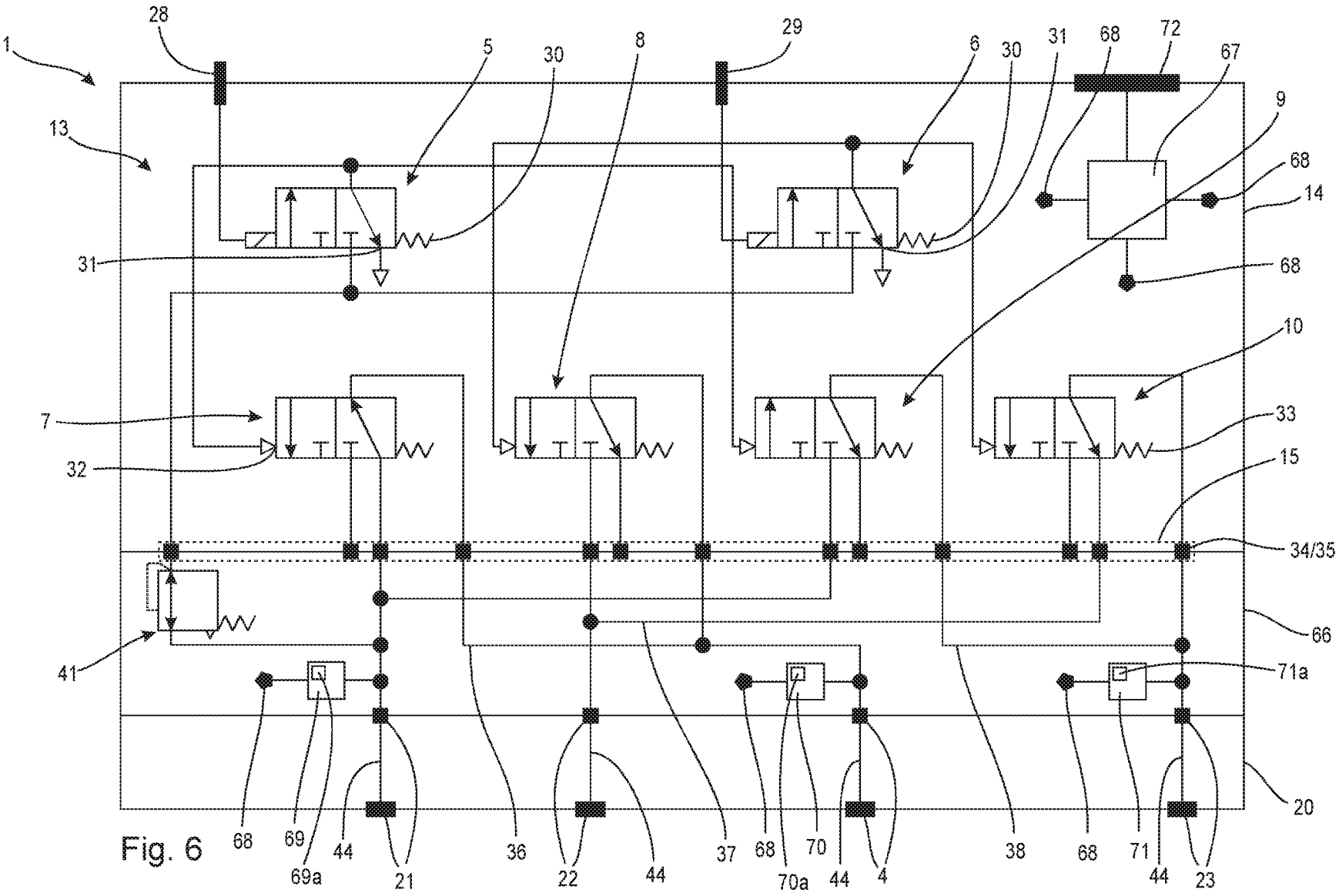

In the second embodiment of the passage body 66 shown in FIG. 6, the pilot valves 5, 6 and main valves 7 to 10 forming the base body 14 are fluidically interconnected in similar fashion to the illustration of FIG. 5. Accordingly, the same conditions as in FIG. 5 apply at the respectively assigned fluid ports 34. Varying from this, in FIG. 6 the base body 14 is also provided with a processing device 67, which is connected electrically to pressure sensors 69, 70, 71 by connection means 68, shown only in schematic form. The connection means 68 may be for example electrical lines, not shown in detail, which pass through the base body 14 and, after passing through an electrical interface, not shown, in particular a plug connection, also pass through the passage body 66 and are connected to the respective pressure sensor 69, 70, 71. By way of example it is provided that the pressure sensors 69, 70, 71 each include a memory device 69*a*, 70*a*, 71*a*, for the storage of measured values and/or parameters. In addition or alternatively, the passage body may be provided with a memory device, not shown in detail, designed for example for storage of identification data of the passage plate 66. For example this memory device may be in the form of an RFID module (radio frequency identification device) for wireless information transmission to a suitable configured processing device in the base body 14. Also provided on the base body 14 is a data interface 72, which facilitates data interchange between the processing device 67 and the control electronics 2.

In the second embodiment of the passage body 66 shown in FIG. 6, the pilot valves 5, 6 and main valves 7 to 10 forming the base body 14 are fluidically interconnected in similar fashion to the illustration of FIG. 5. Accordingly, the same conditions as in FIG. 5 apply at the respectively assigned fluid ports 34. Varying from this, in FIG. 6 the base body 14 is also provided with a processing device 67, which is connected electrically to pressure sensors 69, 70, 71 by connection means 68, so shown only in schematic form. The connection means 68 may be for example electrical lines, not shown in detail, which pass through the base body 14 and, after passing through an electrical interface, not shown, in particular a plug connection, also pass through the passage body 66 and are connected to the respective pressure sensor 69, 70, 71. By way of example it is provided that the pressure sensors 69, 70, 71 each include a memory device, not shown in detail, for the storage of measured values and/or parameters. In addition or alternatively, the passage body may be provided with a memory device, not shown in detail, designed for example for storage of identification data of the passage plate 66. For example this memory device may be in the form of an RFID module (radio frequency identification device) for wireless information transmission to a suitable configured processing device in the base body 14. Also provided on the base body 14 is a data interface 72, which facilitates data interchange between the processing device 67 and the control electronics 2.

The pressure sensor 69 is by way of example assigned to the supply port 21, the pressure sensor 70 for example is assigned to the operating port 4, and the pressure sensor 71 is assigned for example to the reserve port 23. Through the integration of the pressure sensors 69, 70, 71 in the passage body 66 it is possible to carry out monitoring of the functioning of the main valves 7 to 10 and the upstream pilot valves 5, 6, enabling the control unit 1 thus equipped to satisfy where applicable a given safety level within a presettable safety standard.

In addition or as an alternative to the passage body 66, the control unit 1 may, to reach a given safety level within a presettable safety standard, also be equipped with the valve plate 25, which may be fitted with flat contact to the surface 43 of the connection plate 20, and which has on a surface facing the connection plate 20 fluid ports, not visible in the view of FIG. 3, which correspond to the fluid ports 4, 21, 22, 23 of the connection plate 20. At a surface 26 of the valve plate 25 facing the connection plate 20, the operating port 4, the 21, the air outlet port 22 and the reserve port 23 are likewise provided. Moreover, at a side face of the valve plate 25 there is formed a control connection 27. The control connection 27 provides for electrical control of a control valve, not shown and provided in the valve plate 25, with the aid of which the opening or closing of a fluidically communicating connection between the operating port 4 on the connection plate 20 and the operating port 4 on the valve plate 25 may be undertaken. At the same time it may be provided that a control signal provided at the control connection. 27 is supplied by a safety-oriented controller, not depicted.

As an alternative to this, for the valve plate 45 shown in FIG. 4, according to the illustration of FIG. 7, a switching valve 46 in the form for example of a 3/3-way valve is provided and interposed fluidically between the fluid ports formed on opposite surfaces 47, 48 of the valve plate 45, in particular the operating port 4, the supply port 21 and the air outlet port 22. The switching valve 46 is designed for high fluid volume flows and may be controlled with the aid of the control unit 1. By way of example it is provided that a first connection 49 of the switching valve 46 is connected fluidically to a fluid line 50 extending between the operating ports 4. A second connection 51 of the switching valve 46 is so connected to a fluid line 52, which extends between the air outlet ports 22. A third connection 53 of the switching valve 46 is connected fluidically via a fluid line 54 to the operating ports 4. Inserted in a sub-branch 55 of the fluid passage 54 is a restrictor 56, preferably adjustable, wherein the sub-branch 55 is guided at a control connection 57 of the fluidically controllable switching valve 46. Accordingly, control of the switching valve 46 may be effected both by a fluid flow from the control unit 1 via the operating port 4, and also by a fluid flow from the supply port 21 via the switching valve 46 and the sub-branch 55. This ensures in particular a self-retaining switch position for the switching valve 46 during supply of the fluid load, not shown, connected to the operating port 4. In a third switch position all connections 49, 51, 53 are closed, so that no fluid flow is possible via the switching valve 46. By way of example, the fluid line 54 is assigned a pressure sensor 58, which is connected via electrical connection means 59, not shown in detail, to the processing device 67 shown in FIG. 6, in which the pressure signal of the pressure sensor 58 is processed. Alternatively it may be provided in a variant, not shown, for the pressure sensor to be attached directly to the processing device and connected to the fluid line via a sensor line, also not shown in detail.

The invention claimed is:

1. A valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves, which are designed for fluidic control of the main valves, wherein the base body is assigned a connection plate lying opposite the connection face and through which runs a fluid passage, which leads into an operating port for the connection of the fluid load wherein, between the connection face and the connection plate, there is provided a separate passage body which has at least one connection passage for a fluidically communicating link between at least one of the fluid ports and the operating port, and at least one connecting conduit for a fluidic coupling of at least two fluid ports, and wherein the base body includes the connection plate, and wherein a locating shaft for the passage body is formed in the connection plate, wherein the passage body may be attached in at least one functional position for the fluidically communicating interconnection of the main valves with the operating port and the supply port and the air outlet port in the locating shaft.

2. The valve arrangement according to claim 1, wherein at least one main valve or at least one pilot valve has a preset preferred position.

3. The valve arrangement according to claim 1, wherein, in the connection plate, a further fluid passage is formed which opens out into a supply port or an air outlet port, and wherein, in the passage body, there is formed a further connection passage or a further connecting conduit for a fluidically communicating connection between at least one of the fluid ports and the supply port or the air outlet port or for a fluidic coupling of at least two further fluid ports.

4. The valve arrangement according to claim 3, wherein there are formed in the passage body several connecting conduits, which are designed for presettable fluidic interconnection of the main valves with the operating port and the supply port and the air outlet port.

5. The valve arrangement according to claim 1, wherein the main valves are similarly designed.

6. The valve arrangement according to claim 1, wherein connection means corresponding to one another are located on the base body and on the passage body, and are designed for data interchange between an electronic memory device in the passage body and an electronic processing device in the base body.

7. A valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves, which are designed for fluidic control of the main valves, wherein the base body is assigned a connection plate lying opposite the connection face and through which runs a fluid passage, which leads into an operating port for the connection of the fluid load wherein, between the connection face and the connection plate, there is provided a separate passage body which has at least one connection passage for a fluidically communicating link between at least one of the fluid ports and the operating port, and at least one connecting conduit for a fluidic coupling of at least two fluid ports, and wherein the separately formed connection plate is designed for attachment to the connection face and wherein the connection plate includes a locating shaft for the passage body, wherein the passage body may be attached in at least one functional position for the fluidically communicating interconnection of the main valves with the operating port and the supply port and the air outlet port in the locating shaft.

8. A valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves, which are designed for fluidic control of the main valves, wherein the base body is assigned a connection plate lying opposite the connection face and through which runs a fluid passage, which leads into an operating port for the connection of the fluid load wherein, between the connection face and the connection plate, there is provided a separate passage body which has at least one connection passage for a fluidically communicating link between at least one of the fluid ports and the operating port, and at least one connecting conduit for a fluidic coupling of at least two fluid ports, and wherein a valve plate is connected to the connection plate at the operating port of the connection plate, the valve plate including at least one switching valve, which is designed to influence a fluid flow between a fluid source and a fluid load, wherein a fluidic control connection of the switching valve is in fluidically communicating connection with the operating port and wherein the valve plate is assigned at least one sensor means from the group: pressure sensor, flow sensor, temperature sensor, position sensor, wherein the sensor means are electrically connected to the connection plate or are accommodated in the connection plate.

9. A valve arrangement for a fluidic supply of a fluid load, with several main valves which are connected, with fluidic communication, to respectively assigned fluid ports and which are designed for influencing fluid flows at the fluid ports, wherein the fluid ports are located at least partly on a connection face of a base body, and with electrically controllable pilot valves, which are designed for fluidic control of the main valves, wherein the base body is assigned a connection plate lying opposite the connection face and through which runs a fluid passage, which leads into an operating port for the connection of the fluid load wherein, between the connection face and the connection plate, there is provided a separate passage body which has at least one connection passage for a fluidically communicating link between at least one of the fluid ports and the operating port, and at least one connecting conduit for a fluidic coupling of at least two fluid ports, and wherein a valve plate is connected to the connection plate at the operating port of the connection plate, wherein the valve plate includes at least one switching valve, which is designed to influence a fluid flow between the operating port and a fluid load, wherein an electrical control connection of the switching valve is connected to a control interface and wherein the switching valve has a normally closed position.

* * * * *